US005573121A

United States Patent [19]

McKay et al.

[11] Patent Number: 5,573,121

[45] Date of Patent: Nov. 12, 1996

[54] VENEER SORTING APPARATUS

[75] Inventors: Daryl G. McKay, Collierville; Jimmy R. Richardson, Eads, both of Tenn.; Brian G. Rooney, Vancouver, Canada; John L. Nalley, Southaven, Mass.; Hugh M. Waldrop, Memphis, Tenn.; Peter W. Gibson, Maple Ridge, Canada

[73] Assignee: Durand-Raute Industries Ltd., New Westminster, Canada

[21] Appl. No.: 334,514

[22] Filed: Nov. 3, 1994

[51] Int. Cl.[6] ..... B07C 5/14

[52] U.S. Cl. ..... 209/518; 209/521; 209/586; 209/659

[58] Field of Search ..... 209/518, 521, 209/576, 577, 586, 587, 659, 939, 923; 198/367, 370.01

[56] References Cited

U.S. PATENT DOCUMENTS 3,717,249 2/1973 Faley ..... 209/586 X
4,256,214 3/1981 Back, Jr. ..... 198/367

FOREIGN PATENT DOCUMENTS 949027 6/1974 Canada .

*Primary Examiner*—David H. Bollinger
*Attorney, Agent, or Firm*—Marger, Johnson, McCollom & Stolowitz, P.C.

[57] ABSTRACT

Veneer sorting apparatus for sorting a moving stream of arbitrarily ordered full width, random width, fishtail and trash veneer pieces in response to a signal representative of a characteristic such as width. Each piece is deflected into an appropriate output path: one path contains substantially only full width pieces, a second path contains substantially only trash pieces, and a third path contains substantially only fishtail and random width veneer pieces. A first vacuum source is coupled to a first series of vacuum ports positioned closely proximate to and spaced transversely across the moving stream. Vacuum applied through the ports initially draws all the pieces toward the full width output path. Dampers responsive to the characteristic signal temporarily decouple the vacuum ports from the vacuum source upon detection of a trash piece, allowing the trash to fall away from the full width output path. To further assist in trash removal, an air jet responsive to the characteristic signal is provided adjacent the first vacuum ports to blow trash pieces into the trash output path; and, a first pivotable finger downstream of the vacuum ports responds to the signal by deflecting trash into the trash output path. A second pivotable finger downstream of the first finger responds to the signal by deflecting fishtail and random width pieces into the fishtail and random width output path.

11 Claims, 3 Drawing Sheets

VENEER SORTING APPARATUS

FIELD OF THE INVENTION

This application pertains to apparatus for sorting a rapidly moving, arbitrarily ordered stream of veneer pieces into separate output paths; one path containing substantially only full width pieces, a second path containing substantially only trash pieces, and a third path containing substantially only fishtail and random width veneer pieces.

BACKGROUND OF THE INVENTION

Wood veneer is made by a veneer-peeling lathe which peels logs to produce a veneer ribbon. The ribbon is transported along a conveyor to a clipper which optically scans the veneer and cuts it into pieces. A computer coupled between the scanner and the clipper is programmed to optimize production of high quality full width pieces by activating the clipper such that perceived veneer defects are isolated into smaller width "trash" veneer pieces.

The veneer pieces output by the clipper travel along another conveyor. Typically, four different types of veneer pieces are output by the clipper:

1. "Full width" pieces which are rectangular in shape, four feet wide, and do not have open surface defects exceeding a predefined minimum area.
2. "Random width" pieces which are rectangular in shape, less than four feet wide, and do not have open surface defects exceeding a predefined minimum area.
3. "Fishtail" pieces which have a useable surface area but are characterized by a wavy trailing edge giving such pieces a non-rectangular shape.
4. "Trash" pieces comprising all veneer pieces other than the three types listed above.

The clipper's output conveyor carries a rapidly moving, arbitrarily ordered stream containing pieces of each of the four types mentioned above. The stream must be sorted into different output paths, with each path containing substantially only pieces of the same type. For example, one path contains substantially only full width veneer pieces which can be processed together to manufacture high quality plywood. The other output paths can similarly be processed in a more efficient manner than would be the case if one had to work directly with the clipper's output stream in producing articles manufactured from veneer.

The present invention provides a veneer sorting apparatus which automates the process of sorting the clipper's output stream to yield different output paths, each containing veneer of a particular type.

SUMMARY OF THE INVENTION

In accordance with the preferred embodiment, the invention provides a veneer sorting apparatus for sorting a moving stream of arbitrarily ordered full width, random width, fishtail and trash veneer pieces in response to a signal representative of a piece characteristic indicative of whether the respective pieces are full width, random width, fishtail or trash. Each piece is deflected into an appropriate output path. For example, one path may contain substantially only full width veneer pieces, a second path may contain substantially only trash veneer pieces, and a third path may contain substantially only fishtail and random width veneer pieces.

A first vacuum source is coupled to a first series of vacuum ports positioned closely proximate to and spaced transversely across the moving stream. Vacuum applied through the ports initially draws all of the veneer pieces toward the output path which is to contain substantially only full width veneer pieces. Dampers responsive to the piece characteristic signal temporarily decouple the vacuum ports from the vacuum source upon detection of a trash veneer piece, allowing the trash piece to fall away from the full width output path. To further assist in trash removal, an air jet responsive to the characteristic signal is provided adjacent the first vacuum ports to blow trash pieces into the trash output path.

A first pivotable finger downstream of the vacuum ports also responds to the piece characteristic signal by pivoting to deflect trash pieces into the trash output path. Similarly, a second pivotable finger downstream of the first finger responds to the piece characteristic signal by deflecting the fishtail and random width veneer pieces into the fishtail and random width output path.

A second vacuum source may be coupled to a second plurality of vacuum ports downstream of the first ports, closely proximate to and spaced transversely across the output path which is to contain substantially only full width veneer pieces. The second vacuum source continues to draw full width veneer pieces toward the output path which is to contain substantially only full width veneer pieces.

The full width output path may be divided to provide another output path containing substantially only full width veneer pieces. Specifically, a third pivotable finger downstream of the second finger responds to the piece characteristic signal by deflecting some full width pieces from the first output path containing substantially only full width pieces into the other output path containing substantially only full width pieces.

The piece characteristic signal may be representative of the width of each veneer piece, with full width veneer pieces being defined as those having a width greater than a first selected width; trash pieces being defined as those having a width less than a second selected width; and fishtail and random width pieces being defined as those having a width less than the first selected width and greater than the second selected width.

The definition of trash veneer pieces may be extended to include any piece having open defects which exceed a predetermined threshold. The piece characteristic signal may be further representative of the extent of open defects in each veneer piece. In such case the dampers may additionally respond to the signal by temporarily decoupling the first vacuum ports from the first vacuum source upon detection of open defect trash pieces, allowing such trash to fall away from the output path which is to contain substantially only full width veneer pieces. The air jet may also be responsive to the signal to blow such open defect trash pieces into the trash output path.

DETAILED DESCRIPTION OF THE PREFERRED EMBODIMENT

Figure 1:
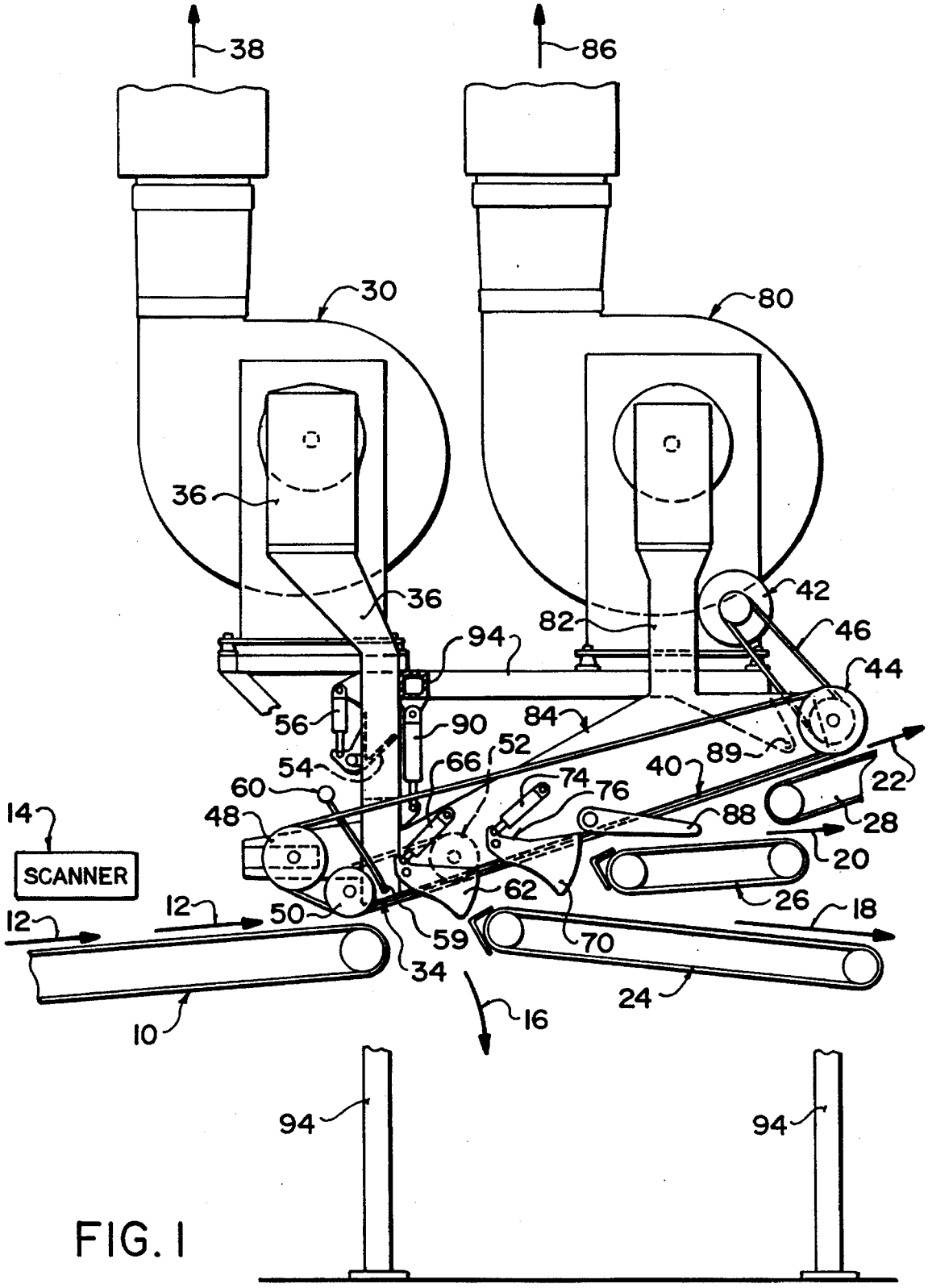
FIG. 1 is a side elevation of view of a veneer sorting apparatus constructed in accordance with the invention.

FIG. 1 depicts conveyor 10 along which a rapidly moving, arbitrarily ordered stream of veneer pieces output by a veneer clipper (not shown) flows in the direction of arrows 12. Scanner 14 (which may be the same scanner used to control the clipper) optically scans the veneer and produces, for each veneer piece, an output signal representative of a veneer piece characteristic such as width, or the extent of any open surface defects in the veneer piece, or both.

The objective is to sort the veneer pieces from stream 12 into four separate output paths denoted by arrows 16, 18, 20 and 22, such that each output path contains substantially only veneer pieces of the same type. Thus, arrow 16 denotes the path along which trash pieces are to be allowed to fall; arrow 18 denotes the path along which random width and fishtail pieces are to be directed along conveyor 24; and, arrows 20, 22 denote two separate paths along which full width veneer sheets are to be directed along conveyors 26, 28 respectively.

A first vacuum source consisting of fan assembly 30 driven by motor 32 draws air upwardly through a first plurality of vacuum ports 34 and plenum 36. The air is exhausted in the direction indicated by arrow 38 (FIG. 1). The open ends of vacuum ports 34 project downwardly between the multiple belts comprising conveyor 40 to position ports 34 closely proximate to the end of conveyor 10 and thus closely proximate to the input stream of veneer pieces. All veneer pieces in the input stream are accordingly initially drawn upwardly against the underside of conveyor 40, which is powered by motor 42 driving pulley 44 via belt 46. The belts comprising conveyor 40 are entrained over pulleys 48, and over additional pulleys (not shown) fixed on shaft 53.

A series of short conveyor belts 51 entrained over pulleys 50, 52 fill the gaps between the belts comprising conveyor 40 in the region beneath ports 34. Belts 51 support shorter trash pieces which may come within the gaps between the belts comprising conveyor 40. Such shorter pieces are not supported by conveyor 40. Belts 51 are driven by fixing pulleys 50 on a shaft 53 to which pulleys driven by belts 40 are also fixed. Belts 40 thus indirectly drive belts 51.

Figure 2:
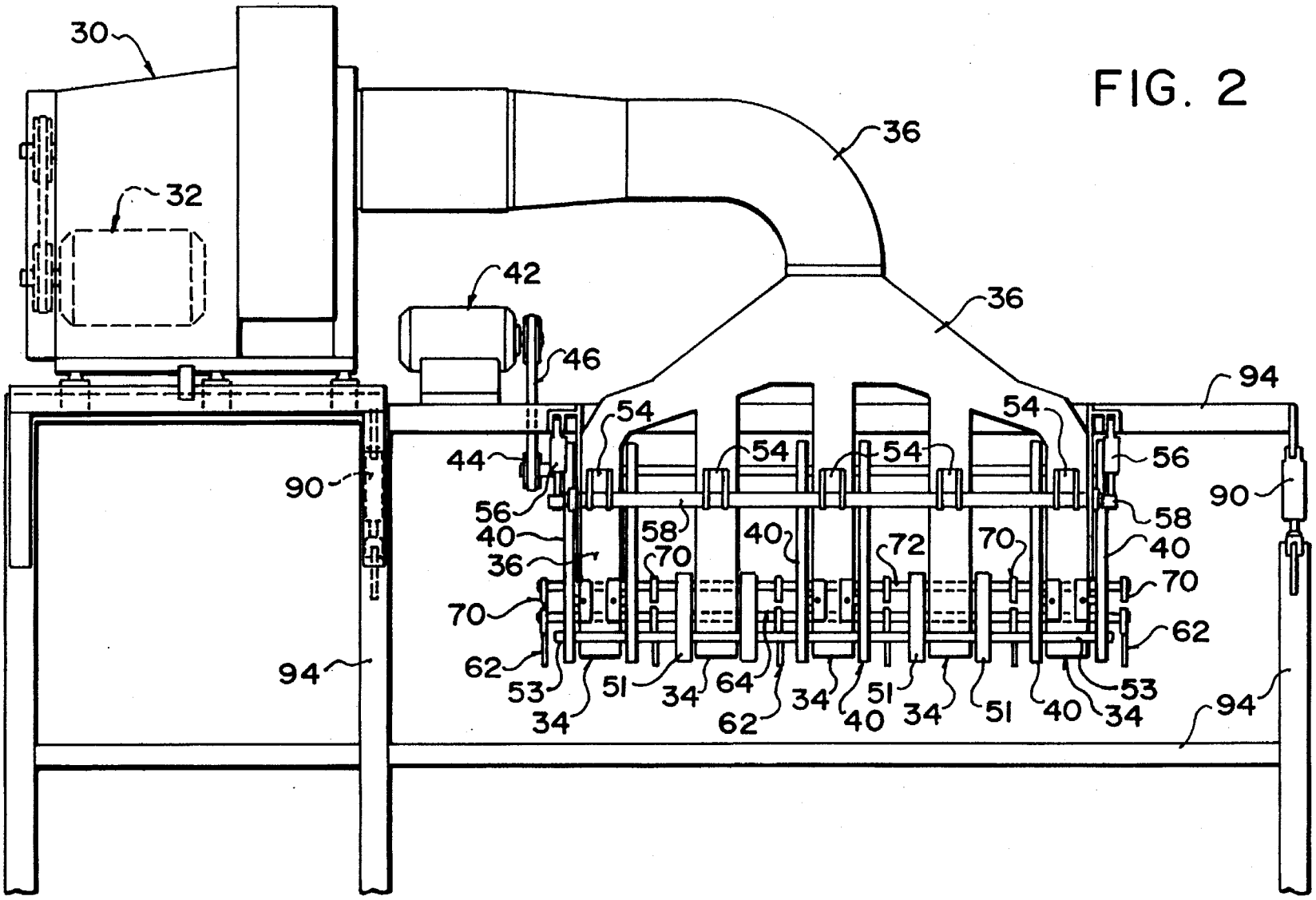
FIG. 2 is a left side elevation view of the FIG. 1 apparatus.

A series of pivotable dampers 54 are mounted within each of the upwardly extending portions of plenum assembly 36, away from vacuum ports 34. Dampers 54 are pivotably actuated by power cylinders 56 in response to the veneer piece characteristic signal aforesaid. As best seen in FIG. 2, the rod ends of cylinders 56 are respectively coupled to the ends of rotatable shaft 58. Dampers 54 are fixed to shaft 58. The veneer piece characteristic signal is synchronized with arrival of veneer pieces beneath ports 34. If the signal indicates that the arriving piece is trash, then cylinders 56 are actuated to close dampers 54. This temporarily decouples ports 34 from the vacuum source, thereby allowing trash pieces to fall away from conveyor 40 along trash output path 16. If the signal indicates that the arriving piece is not trash, cylinders 56 are actuated to leave dampers 54 in their normally open position.

To further assist in trash removal, a plurality of air jets 59 responsive to the veneer piece characteristic signal are provided adjacent each of ports 34. A compressed air source (not shown) is coupled to air jets 59 via supply pipe 60. If the veneer piece characteristic signal indicates that the veneer piece arriving beneath ports 34 is trash, then air jets 59 are opened to blast compressed air through jets 59 and blow the trash downwardly along output path 16. If the signal indicates that the arriving piece is not trash, air jets 59 remain closed.

Figure 3:
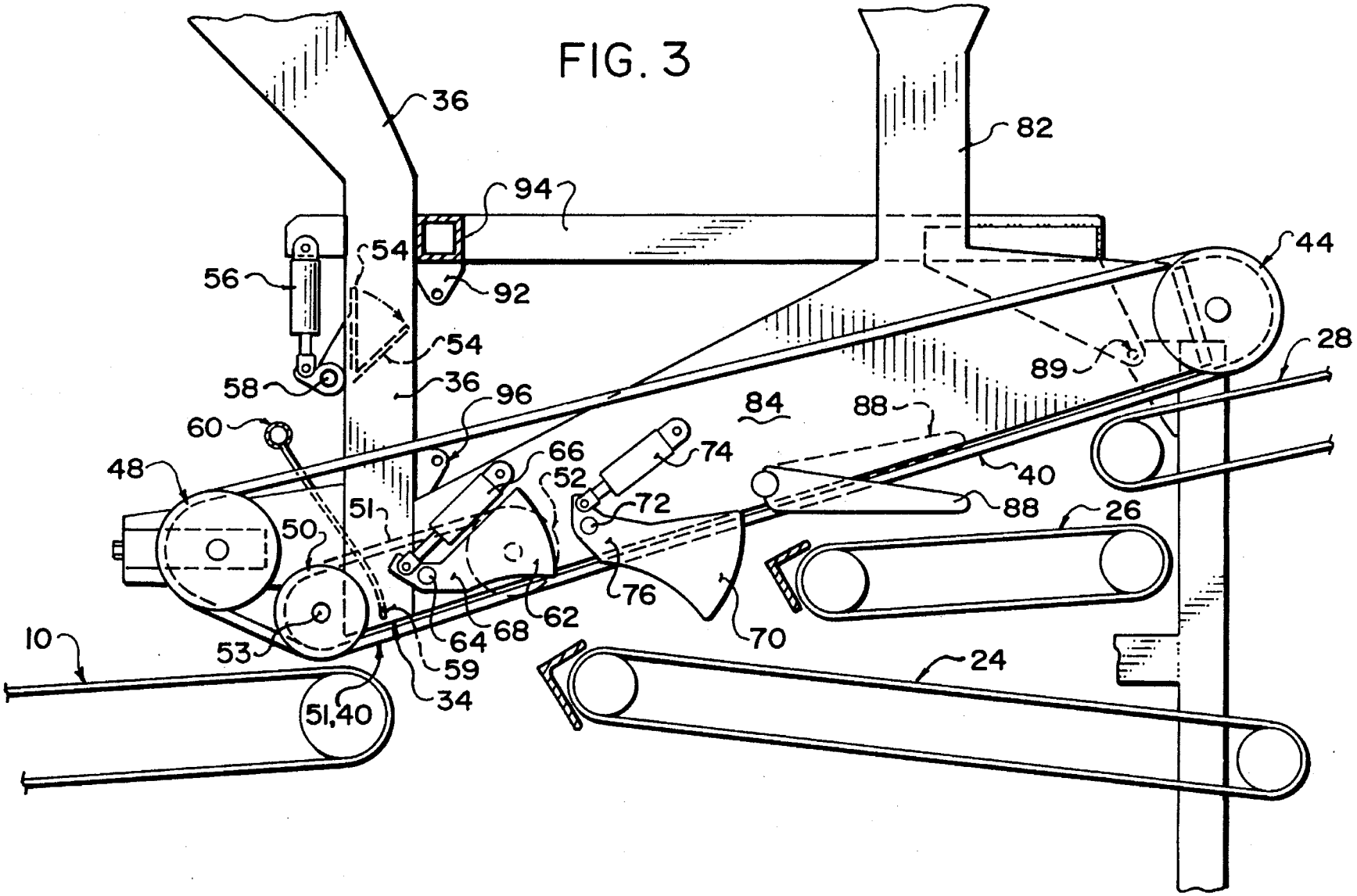
FIG. 3 is an enlarged illustration of a portion of the apparatus depicted in FIG. 1.

Still further assistance in trash removal is provided by a series of first pivotable fingers 62 which are fixed on rotatable shaft 64 to project between vacuum ports 34. A pair of power cylinders (only one of which, 66 is visible in the drawings) coupled to bell cranks 68 mounted on the outer ends of shaft 64 are actuated in response to the veneer piece characteristic signal. If the signal indicates arrival of a trash piece beneath ports 34, cylinders 66 are actuated to pivot fingers 62 downwardly from their normally withdrawn position seen in FIG. 3 into the extended position seen in FIG. 1. When in the extended FIG. 1 position, fingers 62 deflect trash pieces off the underside of conveyor 40 so that they fall downwardly along trash output path 16. If the signal indicates that the arriving piece is not trash, fingers 62 remain in their normally withdrawn position seen in FIG. 3.

A second set of pivotable fingers 70 are provided downstream of fingers 62, between the respective belts comprising conveyor 40. Fingers 70 are fixed on shaft 72, which is rotatably actuated in response to the veneer piece characteristic signal by a pair of power cylinders (only one of which, 74, is seen in the drawings) coupled to bell cranks 76 mounted on the outer ends of shaft 72. If the signal indicates arrival of a fishtail or random width piece beneath fingers 70, then cylinders 74 are actuated to move fingers 70 downwardly from a normally retracted position (not shown) into the extended position seen in FIGS. 1 and 2, thereby deflecting the random width or fishtail veneer piece downwardly from the underside of conveyor 40 onto conveyor 24 for output along path 18. If the signal indicates that the arriving piece is not a fishtail or random width piece then fingers 62 remain in their normally retracted position.

A second vacuum source incorporating motor driven fan assembly 80 is coupled through a second plenum assembly 82 to a series of vacuum ports 84 positioned downstream of the respective first plurality of vacuum ports 34. Air drawn through ports 84 and plenum 82 by fan 80 is exhausted in the direction indicated by arrow 86 (FIG. 1). The resultant vacuum force continues to draw upwardly against the undersurface of conveyor 40 veneer pieces which have not previously been dislodged to fall along trash output path 16 or to progress along fishtail and random width output path 18. More particularly, substantially only full width veneer pieces remain against the undersurface of conveyor 40 at points downstream of second fingers 70.

Fingers 62 and 70 have concave lower surfaces which assist in "peeling" veneer pieces away from conveyor 40 when fingers 62, 70 are extended downwardly into their respective operating positions. This peeling action, coupled with the momentum of the rapidly moving veneer piece, allows fingers 62 or 70 to be retracted above conveyor 40's veneer transfer path before the deflected piece's trailing edge passes fingers 62 or 70. This in turn facilitates high speed sorting of rapidly moving streams of closely spaced veneer pieces. Inertial effects which may hamper high speed operation of fingers 62 or 70 may be reduced by providing a plurality of apertures in fingers 62 or 70 to reduce the fingers' mass.

It will be noted that first vacuum ports 34 extend adjacent only a narrow initial portion of the underside of conveyor 40, whereas second ports 84 are much wider, extending adjacent substantially the entire remaining underside of conveyor 40. Ports 34 accordingly provide high vacuum (interruptible by dampers 54) over a short distance, with ports 84 providing low vacuum over an extended distance. This arrangement has been found suitable for ensuring that all veneer pieces are initially lifted upwardly away from conveyor 10 to facilitate reliable trash separation.

If desired, the full width pieces may be divided into two output paths 20, 22 by suitably activating a third set of pivotable fingers 88. If fingers 88 are in the extended position shown in FIG. 1 and shown in solid outline in FIG. 3 then full width veneer pieces are deflected from the underside of conveyor 40 by finger 88 onto the upper surface of conveyor 26 for passage along full width output path 20. Alternatively, if fingers 88 remain in the retracted position illustrated by dotted outline in FIG. 3 then the full width pieces remain on the underside of conveyor 40 and are ultimately dislodged therefrom onto the upper surface of conveyor 28 for passage along full width output path 22.

Conveyor 40 may be pivoted upwardly or downwardly about pivot point 89 (FIG. 3) by actuating cylinder 90 (FIG. 1) which is coupled between lug 92 (FIG. 3) fixed to support frame 94 and lug 96 fixed to conveyor 40. This facilitates clearance of blockages which may occur if veneer pieces become jammed between pulley 50 and conveyor 10.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. Veneer sorting apparatus for sorting a moving stream of variable width veneer pieces conveyed into said apparatus, by deflecting said respective pieces into one of three output paths in response to a signal representative of width of said respective pieces such that each of said paths contains substantially only veneer pieces having a selected width range, said apparatus comprising:

(a) a first vacuum source;

(b) a first plurality of vacuum ports coupled to said first vacuum source, positioned closely proximate to said conveyed moving stream and spaced transversely across said conveyed moving stream to draw said veneer pieces toward a first one of said output paths;

(c) a plurality of dampers coupled to said respective first vacuum ports and responsive to said signal to temporarily decouple said first vacuum ports from said first vacuum source if a veneer piece having a width less than a first selected width is adjacent any of said first vacuum ports;

(d) a first pivotable finger downstream of said first vacuum ports and responsive to said signal to sort veneer pieces having a width less than a second selected width by deflecting said pieces having a width less than said second selected width into a second one of said output paths; and, (e) a second pivotable finger downstream of said first finger and responsive to said signal to sort veneer pieces having a width less than said first selected width and greater than said second selected width by deflecting said pieces having a width less than said first selected width and greater than said second selected width into a third one of said output paths.

2. Veneer sorting apparatus as defined in claim 1, further comprising an air jet responsive to said signal to blow veneer pieces having a width less than said second selected width into said second output path.

3. Veneer sorting apparatus as defined in claim 2, further comprising:

(a) a second vacuum source; and, (b) a second plurality of vacuum ports coupled to said second vacuum source, positioned closely proximate to said first output path and spaced transversely across said first output path to draw toward said first output path veneer pieces having a width greater than said first selected width.

4. Veneer sorting apparatus as defined in claim 3, further comprising:

(a) a fourth output path; and, (b) a third pivotable finger downstream of said second finger and responsive to said signal to deflect some of said veneer pieces having a width greater than said first selected width from said first output path into said fourth output path.

5. Veneer sorting apparatus as defined in claim 2, wherein:

(a) said signal is further representative of extent of any open defects in each of said veneer pieces; and, (b) said dampers are further responsive to said signal to decouple said first vacuum ports from said first vacuum source upon detection of a veneer piece having open defects exceeding a predetermined threshold.

6. Veneer sorting apparatus as defined in claim 5, wherein said air jet is further responsive to said signal to blow into said second output path veneer pieces having open defects exceeding a predetermined threshold.

7. Veneer sorting apparatus as defined in claim 2, wherein said first and second pivotable fingers have concave lower surfaces.

8. Veneer sorting apparatus for sorting a moving stream of arbitrarily ordered full width, random width, fishtail and trash veneer pieces conveyed into said apparatus, by deflecting said respective pieces into one of three output paths in response to a signal representative of whether said respective pieces are full width, random width, fishtail or trash pieces such that a first one of said paths contains substantially only full width veneer pieces, a second one of said paths contains substantially only trash veneer pieces, and a third one of said paths contains substantially only fishtail and random width veneer pieces, said apparatus comprising:

(a) a first vacuum source;

(b) a first plurality of vacuum ports coupled to said first vacuum source, positioned closely proximate to and spaced transversely across said conveyed moving stream to initially draw all of said veneer pieces toward said output path containing substantially only full width veneer pieces;

(c) a plurality of dampers coupled to said respective first vacuum ports and responsive to said signal to temporarily decouple said first vacuum ports from said first vacuum source if a trash veneer piece is adjacent any of said first vacuum ports;

(c) a first pivotable finger downstream of said first vacuum ports and responsive to said signal to sort said trash veneer pieces by deflecting said trash veneer pieces into said output path containing substantially only trash veneer pieces; and, (d) a second pivotable finger downstream of said first finger and responsive to said signal to sort said fishtail and random width veneer pieces by deflecting said fishtail and random width veneer pieces into said output path containing substantially only fishtail and random width veneer pieces.

9. Veneer sorting apparatus as defined in claim 8, further comprising an air jet responsive to said signal to blow said trash veneer pieces into said output path containing substantially only trash veneer pieces.

10. Veneer sorting apparatus as defined in claim 9, further comprising:

(a) a second vacuum source; and, (b) a second plurality of vacuum ports coupled to said second vacuum source, positioned closely proximate to and spaced transversely across said output path containing substantially only full width veneer pieces to draw said full width veneer pieces toward said output path containing substantially only full width veneer pieces.

11. Veneer sorting apparatus as defined in claim 10, further comprising:

(a) a fourth output path containing substantially only full width veneer pieces; and, (b) a third pivotable finger downstream of said second finger and responsive to said signal to deflect some of said full width veneer pieces from said first output path containing substantially only full width veneer pieces into said fourth output path containing substantially only full width veneer pieces.

* * * * *